US011798462B2

(12) United States Patent
Navabi-Shirazi et al.

(10) Patent No.: US 11,798,462 B2
(45) Date of Patent: Oct. 24, 2023

(54) OPEN LOOP BACKLIGHT LED DRIVER

(71) Applicant: APPLE INC., Cupertino, CA (US)

(72) Inventors: Mohammad J. Navabi-Shirazi, Phoenix, AZ (US); Ming Gu, San Jose, CA (US); Alejandro Lara Ascorra, Gilbert, AZ (US); James E. Brown, San Jose, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 17/507,717

(22) Filed: Oct. 21, 2021

(65) Prior Publication Data

US 2022/0130327 A1 Apr. 28, 2022

Related U.S. Application Data

(60) Provisional application No. 63/104,295, filed on Oct. 22, 2020.

(51) Int. Cl.
*G09G 3/32* (2016.01)
*G09G 5/10* (2006.01)

(52) U.S. Cl.
CPC ..... *G09G 3/32* (2013.01); *G09G 5/10* (2013.01); *G09G 2320/064* (2013.01); *G09G 2360/142* (2013.01); *G09G 2360/147* (2013.01)

(58) Field of Classification Search
None
See application file for complete search history.

(56) References Cited

U.S. PATENT DOCUMENTS

| | | | | |
|---|---|---|---|---|
| 6,972,530 | B1 | 12/2005 | Xin-LeBlanc | |
| 7,928,670 | B2 | 4/2011 | Chen et al. | |
| 8,253,350 | B2 | 8/2012 | Hung et al. | |
| 8,344,657 | B2 | 1/2013 | Zhan et al. | |
| 8,587,209 | B2 | 11/2013 | Soleño | |
| 10,506,676 | B2 | 12/2019 | Lin et al. | |
| 2008/0284720 | A1* | 11/2008 | Fukutome | G02F 1/13454 349/116 |
| 2009/0322234 | A1 | 12/2009 | Chen et al. | |
| 2011/0101877 | A1 | 5/2011 | Zhan et al. | |
| 2012/0274233 | A1 | 11/2012 | Chen et al. | |
| 2013/0257827 | A1* | 10/2013 | Hsieh | G09G 3/342 345/82 |

* cited by examiner

*Primary Examiner* — Andre L Matthews
(74) *Attorney, Agent, or Firm* — KILPATRICK TOWNSEND & STOCKTON LLP

(57) ABSTRACT

Light emitting diode display panels with an open loop amplifier resulting in better brightness accuracy and matching between multiple light emitting diode strings.

16 Claims, 4 Drawing Sheets

OPEN LOOP BACKLIGHT LED DRIVER

CROSS-REFERENCES TO RELATED APPLICATION

This application claims the benefit of U.S. Provisional Application No. 63/104,295, filed Oct. 22, 2020 entitled "Open Loop Backlight Led Driver," the disclosure which is incorporated by reference herein in its entirety.

BACKGROUND

Field

Aspects of the disclosure relate in general to displays. Aspects include a light emitting diode display method and apparatus with an open loop amplifier resulting in better brightness accuracy and matching between multiple light emitting diode strings.

Description of the Related Art

A light-emitting diode (LED) display is a video display that uses a light-emitting diode in which the emissive electroluminescent layer is a film of organic compound that emits light in response to an electric current.

There are two basic kinds of signal types—analog and digital. Analog signal types have degrees of intensity, between 0% (off) and 100% (maximum), allowing for a range of accuracy when determining screen brightness. Digital signal types have no degrees of intensity—they are either in an "off" or an "on" state. With respect to digitally controlled backlights, the backlight is either on or off.

Digital signal controllers are cheaper, smaller, more power efficient, and simpler to implement than analog controls. In order to take advantage of the benefits of digital signal controllers while retaining (and even surpassing) analog functionality, Pulse-Width Modulation (PWM) is used.

Pulse-Width Modulation is a very rapid frequency of on/off states of the digital signal to achieve a result similar to what could be achieved on an analog signal. To achieve 70% screen brightness for example, a digital signal is kept on for 70% of the time and off for 30% of the time. This is done rapidly. The faster the frequency, the less noticeable the off states become, until the resulting effect is indistinguishable from what an analog signal would produce.

SUMMARY

Embodiments include a light-emitting diode display device with an open loop amplifier resulting in better brightness accuracy and matching between multiple light emitting diode strings.

In one embodiment, an apparatus comprises a display panel, a brightness level detector, an integrator, an analog comparator, a peak current driver, and a pulse width modulation control. The display panel has a plurality of light emitting diodes (LEDs). The brightness level detector is configured to measure current delivered to the light emitting diodes. The integrator is configured to determine accumulated charge delivered to the light emitting diodes. The analog comparator is configured to compare the measured current and the determined accumulated charge. The peak current driver is configured to deliver charge to the light emitting diodes. The pulse width modulation control is configured to terminate current from the peak current driver to the light emitting diode when the analog comparator determines that the determined accumulated charge is equal to a target charge associated with the measured current. The apparatus may be a tablet computer, mobile phone, augmented reality display, notebook computer, computer display, or digital watch.

In a method embodiment, the method operates a display panel with a plurality of light emitting diodes. A brightness level detector measures current delivered to the light emitting diodes. An integrator determines accumulated charge delivered to the light emitting diodes. An analog comparator compares the measured current and the determined accumulated charge. A peak current driver delivers charges to the light emitting diodes. A pulse width modulation control terminates current from the peak current driver to the light emitting diode when the analog comparator determines that the determined accumulated charge is equal to a target charge associated with the measured current. The light-emitting diode display panel may be incorporated in a tablet computer, mobile phone, augmented reality display, notebook computer, computer display, or digital watch.

In a multi-channel embodiment, the apparatus comprises a display panel, a brightness level detector, and a plurality of current drivers. The display panel has multiple channels with a plurality of light emitting diodes (LEDs). The brightness level detector is configured to measure current delivered to the light emitting diodes. The plurality of current drivers are configured to deliver charge to the light emitting diodes. Each current driver comprises an integrator, an analog comparator, and a pulse width modulation control. The integrator is configured to determine accumulated charge delivered to the light emitting diodes of at least one of the multiple channels. The analog comparator is configured to compare the measured current and the determined accumulated charge. The pulse width modulation control is configured to terminate current from the peak current driver to the light emitting diode when the analog comparator determines that the determined accumulated charge is equal to a target charge associated with the measured current. The light-emitting diode display panel may be incorporated in a tablet computer, mobile phone, augmented reality display, notebook computer, computer display, or digital watch.

BRIEF DESCRIPTION OF THE DRAWINGS

To better understand the nature and advantages of the present disclosure, reference should be made to the following description and the accompanying figures. It is to be understood, however, that each of the figures is provided for the purpose of illustration only and is not intended as a definition of the limits of the scope of the present disclosure. Also, as a general rule, and unless it is evident to the contrary from the description, where elements in different figures use identical reference numbers, the elements are generally either identical or at least similar in function or purpose.

DETAILED DESCRIPTION

Figure 1:
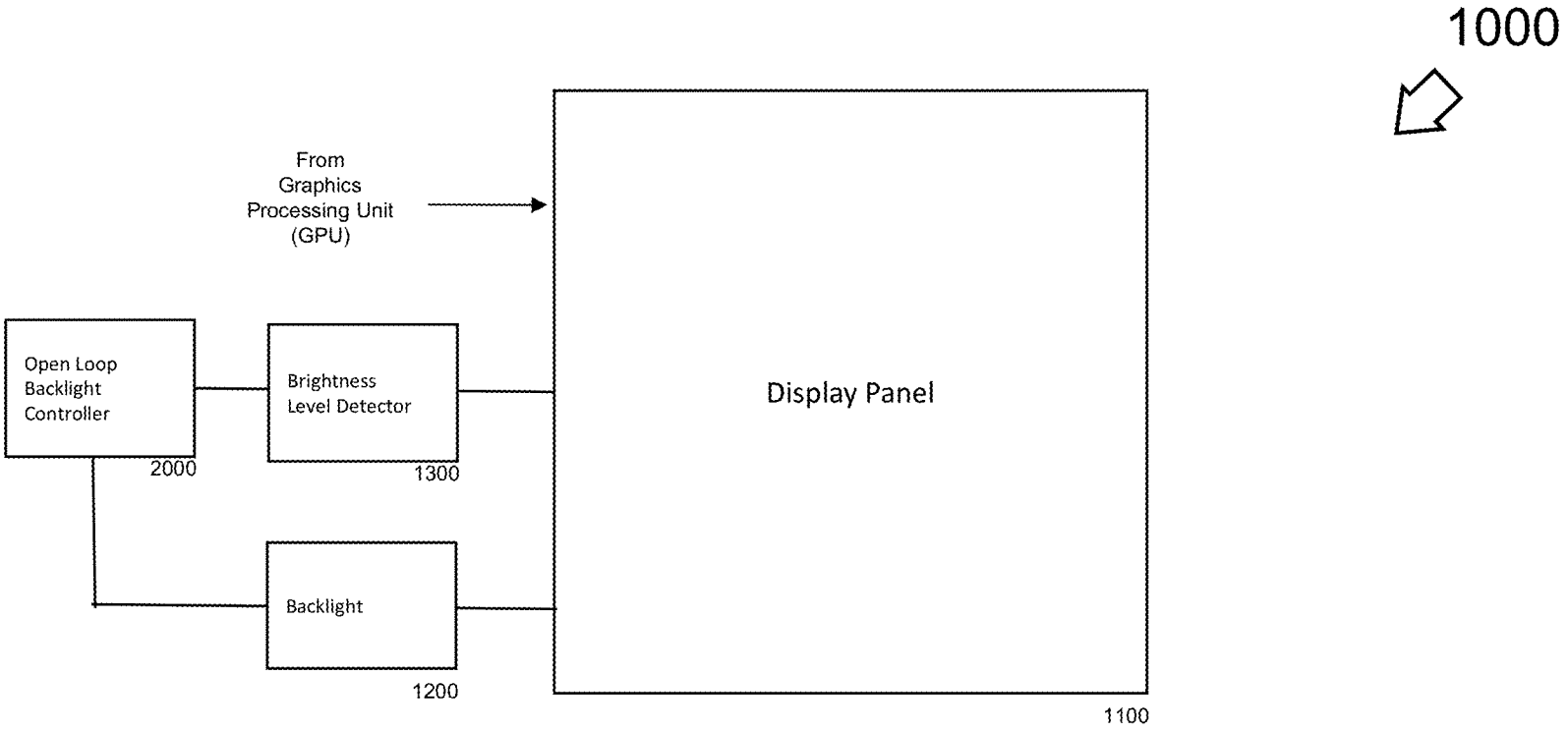
FIG. 1 is a block diagram of an embodiment light-emitting diode display device with an open loop amplifier.

Embodiments describe light-emitting diode display panel designs and methods of pulse width modulation operation with an open loop amplifier resulting in simpler implementation, more accurate brightness control, and matching between multiple light emitting diode strings.

One aspect of the disclosure is the realization that prior art backlight controller/driver chips convert input brightness information to current levels and current pulse duty cycles to drive light-emitting diodes or light-emitting diode strings. In the prior art, LED current is controlled either using linear scaling of the current or by pulse width modulation control where average current is controlled by adjusting the duty cycle of a fixed frequency PWM waveform. Pulse width modulation brightness control is commonly used to avoid color shift at low LED current levels. Mixed mode brightness control is also common where pulse width modulation is used at low brightness to avoid color shift and linear current control is used at higher brightness levels.

Another aspect of the disclosure is the realization that prior art closed loop LED drivers have a number of shortcomings and expensive hardware requirements. When used in pulse width modulation mode, the LED driver relies on accurate control of the peak LED current and the pulse width modulation pulse duty cycle to deliver the required amount of charge to the light emitting diodes. Peak LED current is controlled by a digital-to-analog converter (DAC) followed by a current driver. In such an implementation, the digital-to-analog converter is required to have a high resolution, and the current driver must have a fast and well-controlled response. Furthermore, in a closed loop implementation, a pulse width modulation pulse duty cycle is controlled by a fast phase loop lock (PLL). For 12 bits of pulse width modulation resolution at 20 kHz PWM frequency, the counter clock frequency must be >80 MHz (for direct PWM control without dither). If a passive driver architecture where one current driver drives multiple LED strings, then the counter clock frequency requirements (for a given resolution) become even more stringent. Any deviation in the period or amplitude of the LED current pulse will result in errors, including errors in LED current pulse rise and fall times, overshoot/undershot, and absolute errors in magnitude or duty cycle.

Yet another aspect of the disclosure is the understanding that since a prior art closed loop current driver stage needs to handle full-scale currents, the driver device must be large to handle the large currents at low voltage drops and maintain low power loss. At low brightness levels, this results in very narrow pulses to achieve high resolution. Due to the driver's large size and limited bandwidth in a closed loop driver, the current pulses with very narrow on time get distorted. For example, in order for a closed loop driver to achieve 12 bits of PWM resolution, the duty cycle is controlled to approximately 0.025% of the PWM period (or approximately 10 ns pulse width for $f_{PWM}$=25 kHz). In multi-string applications, each channel should use its own digital analog converter that matches with its current driver in order to meet mismatch requirements.

A further aspect of the disclosure is the realization that an open loop LED driver solves the problems of the closed loop driver. A backlight driver architecture embodiment described herein does not use closed loop amplifier and drives the LED current in pulse width modulation brightness control mode directly using a driver device. In such an embodiment the open loop driver results in faster edges on the LED current pulses, which in turn results in better brightness accuracy and matching between multiple LED strings. Embodiments of the disclosure may be used with LED, liquid crystal display (LCD) or micro-LED displays.

FIG. 1 is a block diagram of a display system 1000, in accordance with an embodiment of the present disclosure. Display system 1000 may be a stand-alone display, or: a computer display, television set, notebook computer, tablet computer, mobile phone, smartphone, augmented reality display, digital "smart" watch, or other digital device. In this embodiment, a display system 1000 comprises a display panel 1100, an open loop backlight controller 2000, backlight 1200, and a. It is understood by those familiar with the art that the system described herein may be implemented in a variety of hardware or firmware solutions.

The display panel 1100 may be an organic light-emitting diode (OLED) display, such as a passive-matrix (PMOLED) or active-matrix (AMOLED). In other embodiments, the display panel 1100 may be a micro-light emitting diode (micro-LED) display. Light emitting pixels of display panel 1100 are organized into rows (lines) and columns. Display panel 1100 is configured to receive an image frame from a graphics-processing unit (not shown).

Backlight 1200 illuminates the display panel 1100, and based on an open loop backlight controller 2000.

Brightness level detector 1300 detects the brightness of an LED by determining the current delivered to the light emitting diode. Based upon the current level, brightness level detector 1300 outputs a voltage representative of the brightness of the LED. This signal can also be interpreted as a desired brightness of the LED.

Figure 2:
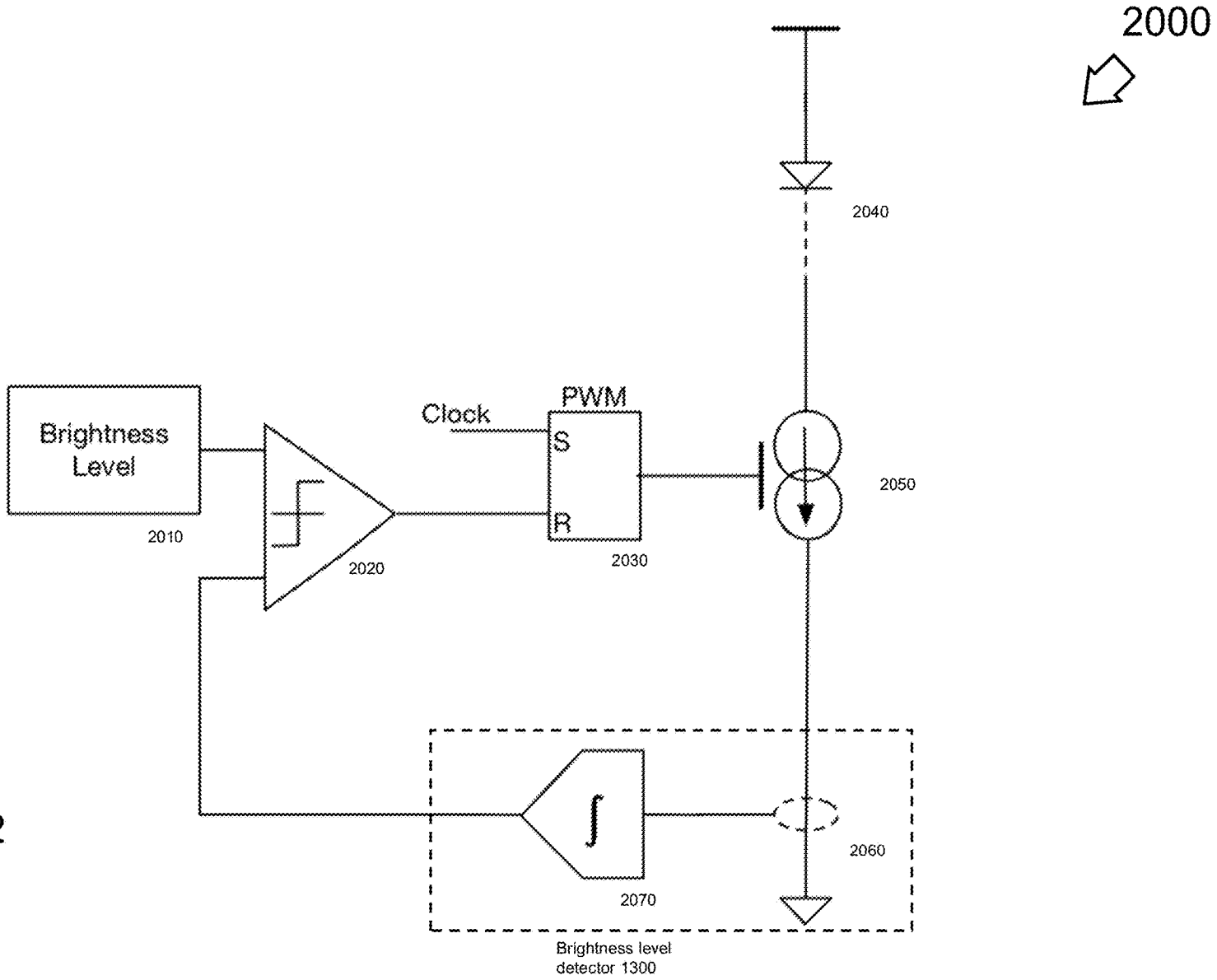
FIG. 2 is a block diagram of an embodiment open loop amplifier configured to be used in a light-emitting diode display device.
Figure 3:
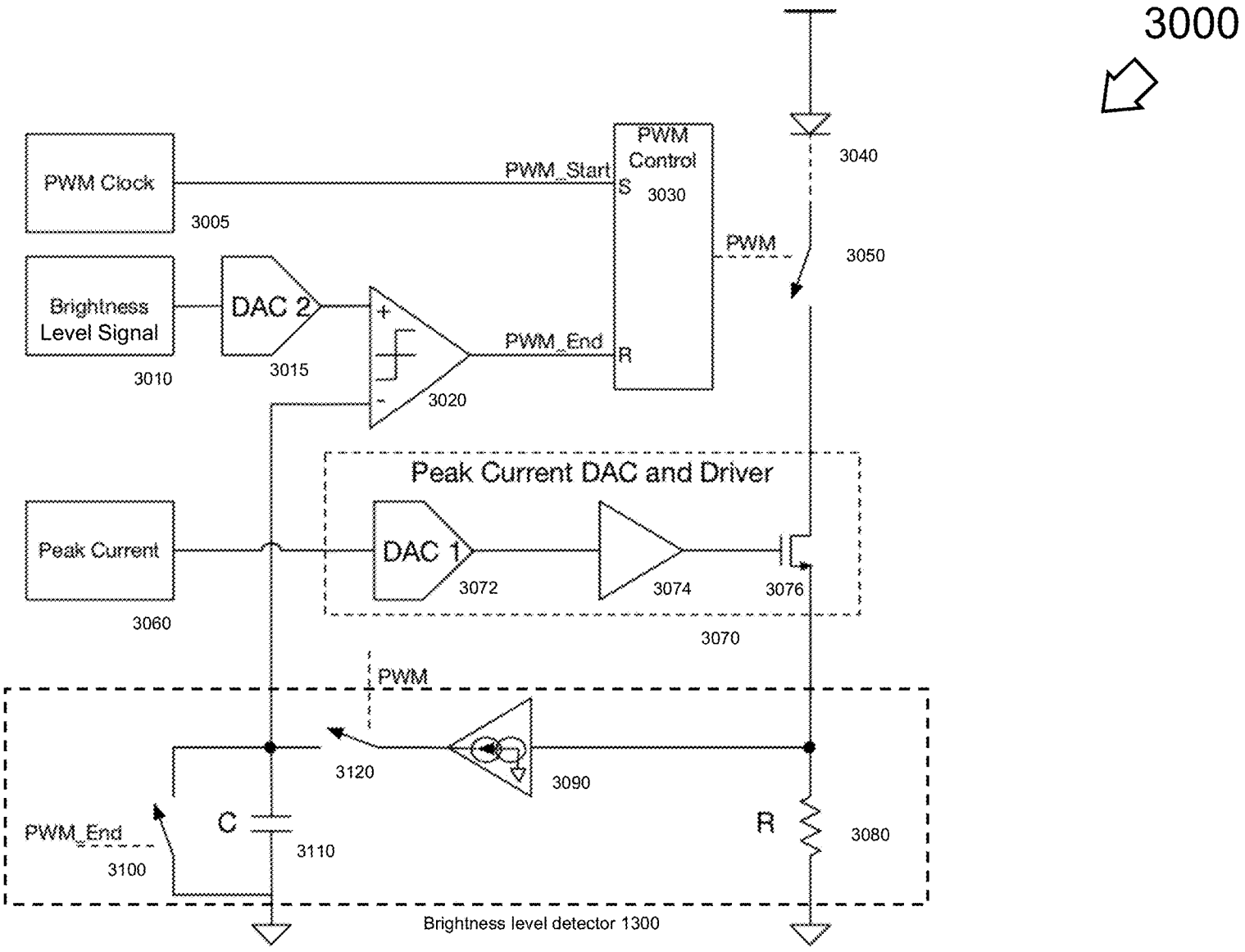
FIG. 3 is a block diagram of an alternate embodiment open loop amplifier configured to be used in a light-emitting diode display device.
Figure 4:
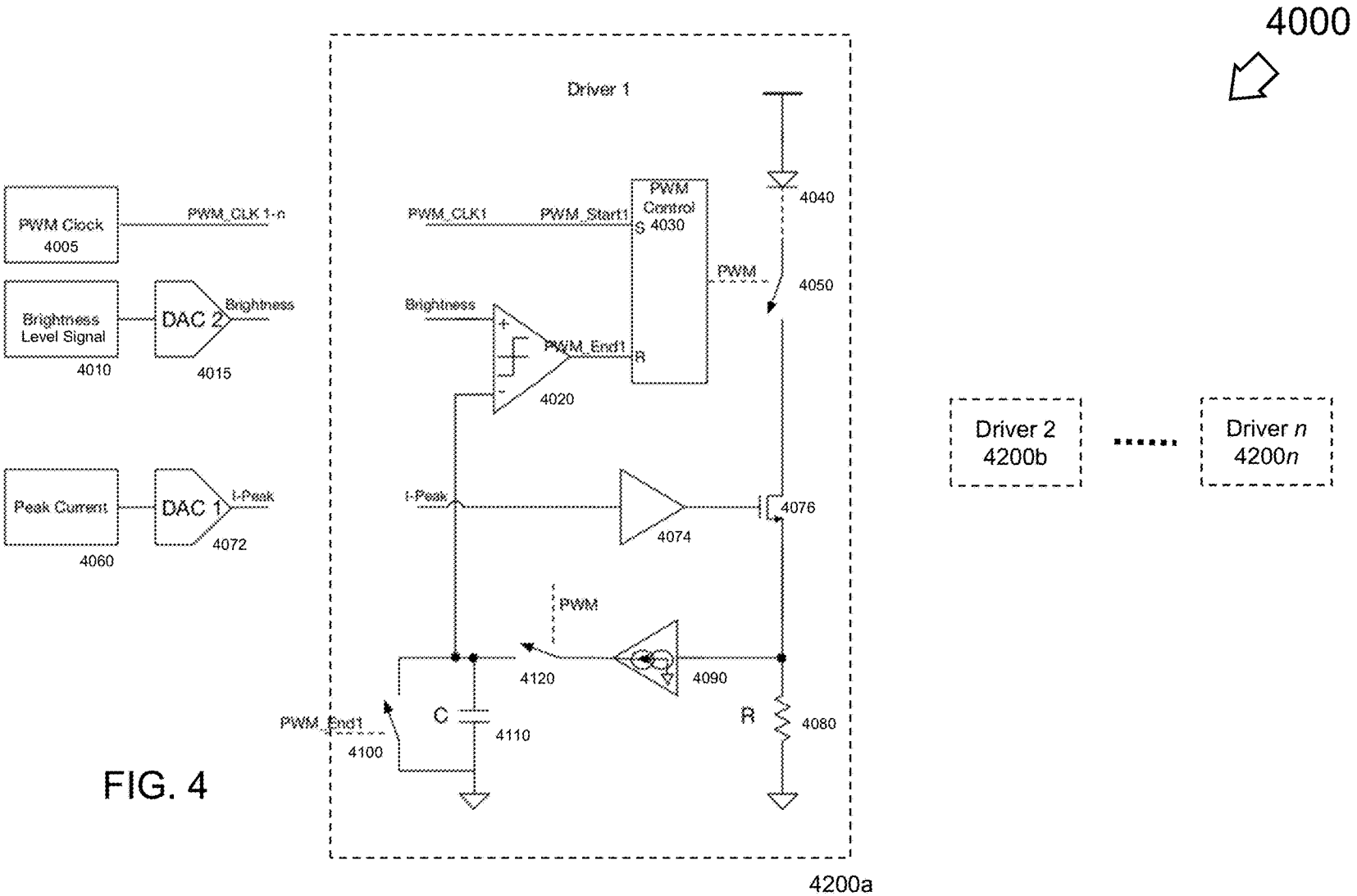
FIG. 4 is a block diagram of another alternate embodiment multi-channel open loop amplifier configured to be used in a light-emitting diode display device.

Embodiments of an open loop backlight controller 2000 are described in greater details in FIGS. 2-4.

Moving to FIGS. 2-4, these figures describe alternate embodiments of an open loop backlight controller 2000, in accordance with an embodiment of the present disclosure. FIG. 2 describes a more generalized version of open backlight controller 2000, while FIG. 3 describes an embodiment in greater detail. FIG. 4 depicts a multi-channel open backlight controller embodiment.

FIG. 2 is a block diagram of an embodiment open loop backlight controller 2000 configured to drive the LED current directly using a driver device. This embodiment open loop backlight controller 2000 comprises analog comparator 2020, pulse width modulation control 2030, current diode 2040, switch 2050, sensor 2060, and integrator 2070. These components are best understood in conjunction with each other.

Operation of the open loop backlight controller 2000 is as follows. Target charge to be delivered to the light emitting diodes of the display panel 1100 is equal to the peak current multiplied by the PWM pulse on time. The open loop backlight controller 2000 receives a desired brightness level signal 2010 which corresponds to the target charge. Analog comparator 2020 is configured to compare the voltage produced by brightness level and output of integrator 2070. Integrator 2070 determines the charge delivered to the LED at issue by integrating the total amount of current detected by sensor 2060. The output of the integrator 2070 is compared with the expected change for a given brightness level. Once the delivered charge is equal to the target charge for a given brightness, at which point the pulse width modulation pulse is terminated by pulse width modulation control 2030 and switch 2050.

Since charge delivered is monitored for the period of the pulse width modulation pulse, the only systematic error is the charge delivered after the pulse width modulation pulse has ended. The LED current pulse falling edge is made as fast to reduce this potential error source.

FIG. 3 is a block diagram of an alternate embodiment open loop amplifier 3000 that may be used in a light-emitting diode display device 1000 instead of the open loop amplifier 2000 described in FIG. 2. This embodiment open loop backlight controller 3000 comprises a pulse width modulation clock 3005, a brightness level detector 1300, a digital-to-analog converter 3015, analog comparator 3020, pulse width modulation control 3030, pulse with modulation clock 3005, current diode 3040, first switch 3050, peak current 3060, and peak current DAC and Driver 3070, resistor 3080, integrator 3090, second switch 3100, capacitor 3110, and third switch 3120.

Peak current DAC and Driver 3070 may further comprise a peak current digital-to-analog converter 3072, a peak current driver 3074, and an n-channel field effect transistor 3076. The peak current DAC and Driver 3070 is configured to receive a peak current input signal 3060, and provide charge to the LED. In this embodiment, peak current input signal 3060 is a digital signal that is converted into an analog signal by the digital-to-analog converter 3072 and provided to the peak current driver 3074. Peak current driver 3074 is an amplifier configured to receive the analog peak current signal and to output an amplified peak current signal to the light emitting diode.

Conceptually, the operation of the open loop backlight controller 3000 is similar to the open loop backlight controller 2000 of FIG. 2. Target charge to be delivered to the light emitting diodes of the display panel 1100 is equal to the peak current multiplied by the PWM pulse on time. In order to control brightness, brightness level detector 1300 measures the current delivered to the light emitting diodes. A brightness level signal 3010 is output by brightness level detector 1300 and is an input to digital-to-analog converter 3015. The resulting signal corresponds to a desired brightness level, and is compared with the output of the integrator 3090—which is a comparison between the accumulated charge and the expected change for a given brightness level. Once the delivered charge is equal to the target charge for a given brightness, the pulse width modulation pulse is terminated by pulse width modulation control 3030 and switch 3050.

There are a few variations and design considerations on this embodiment of the open loop backlight controller 3000.

Peak current digital-to-analog converter 3072 is configured to help set peak current value. Peak current digital-to-analog converter 3072 does not have to be a high-resolution digital-to-analog converter because the precise brightness control does not depend on the actual value of current. For operation in linear mode or linear region of mix mode, peak current digital-to-analog converter 3072 meets the linear region's step size resolution.

Digital-to-analog converter 3015, which is used to detect charge, is designed to meet the brightness step resolution.

Unlike conventional closed loop backlight controllers of the prior art, the pulse width modulation duty period is controlled by the comparison of the measured charge with the target charge (based on brightness). As a result, pulse width modulation clock 3005 does not need to be a high frequency counter clock.

FIG. 4 is a block diagram of an embodiment of a multi-channel driver open loop backlight controller 4000 configured to drive the LED current directly using multiple driver devices. In an alternate multi-channel backlight embodiment, multiple driver components 4200*a-n* may be used to drive multiple (n) independent channels of the display panel 1100, where n is an integer greater than one. In such an embodiment, brightness level detector 1300, pulse width modulation clock 4005, digital-to-analog converter 4015, and peak current digital-to-analog converter 4072 may be shared between multiple channel driver 4200*a-n* embodiments and do not need to be duplicated for each driver. These components can therefore share the PWM clock signal 4005, brightness level signal 4010, and peak current signal 4060.

Driver 4200 further comprises analog comparator 4020, pulse width modulation control 4030, current diode 4040, first switch 4050, peak current driver 4074, an n-channel field effect transistor 3076, resistor 4080, integrator 4090, second switch 4100, capacitor 4110, and third switch 4120.

The operation of the open loop backlight controller 4000 is similar to the open loop backlight controllers described above but with multiple drivers 4200*a-n* corresponding to the n-channels. Target charge to be delivered to the light emitting diodes of a given channel of the display panel 1100 is equal to the peak current multiplied by the PWM pulse on time. In order to control brightness, brightness level detector 1300 measures the current delivered to the light emitting diodes of the channel. The voltage provided by brightness level detector 1300 is provided to digital-to-analog converter 4015, and is compared with the output of the integrator 4090—which is a comparison between the accumulated charge and the expected change for a given brightness level. Once the delivered charge is equal to the target charge for a given brightness, the pulse width modulation pulse is terminated by pulse width modulation control 4030 and switch 4050.

The previous description of the embodiments is provided to enable any person skilled in the art to practice the disclosure. The various modifications to these embodiments will be readily apparent to those skilled in the art, and the generic principles defined herein may be applied to other embodiments without the use of inventive faculty. Thus, the present disclosure is not intended to be limited to the embodiments shown herein, but is to be accorded the widest scope consistent with the principles and novel features disclosed herein.

What is claimed is:

1. An apparatus comprising:

a display panel with a plurality of light emitting diodes (LEDs);

a brightness level detector configured to set target charge delivered to the light emitting diodes for a given brightness level;

an integrator configured to determine accumulated charge delivered to the light emitting diodes;

a analog comparator configured to compare the set target charge and the determined accumulated charge;

a peak current driver configured to deliver charge to the light emitting diodes;

a pulse width modulation control configured to terminate current from the peak current driver to the light emitting diode when the analog comparator determines that the determined accumulated charge is equal to the set target charge associated with the measured current;

a first digital-to-analog converter configured to receive a digital peak current signal and convert the peak current signal into an analog peak current signal; and, an amplifier configured to receive the analog peak current signal and to output an amplified peak current signal to the light emitting diode.

2. The apparatus of claim 1 wherein the first digital-to-analog converter meets a linear region step size resolution.

3. The apparatus of claim 2 wherein the measured current from the brightness level detector is a digital signal.

4. The apparatus of claim 3 further comprising:

a second digital-to-analog converter configured to:

receive the set target charge from the brightness level detector, convert the set target charge into an analog reference voltage, and output the analog reference voltage to the analog comparator.

5. The apparatus of claim 4 wherein the second digital-to-analog converter is designed to meet a brightness step resolution.

6. The apparatus of claim 5 wherein the apparatus is a tablet computer, mobile phone, augmented reality display, notebook computer, computer display, or digital watch.

7. A method of operating a display panel comprising:

measuring current delivered to a light emitting diode of the display panel;

determining accumulated charge delivered to the light emitting diode with an integrator;

comparing the measured current and the determined accumulated charge with a analog comparator;

delivering charge to the light emitting diodes with a peak current driver;

terminating current from the peak current driver to the light emitting diode when the analog comparator determines that the determined accumulated charge is equal to a target charge associated with the measured current with a pulse width modulation control; and, wherein the delivering charge to the light emitting diode further comprises:

receiving a digital peak current signal with a first digital-to-analog converter;

converting the peak current signal into an analog peak current signal with the first digital-to-analog converter;

receiving the analog peak current signal with an amplifier; and, outputting an amplified peak current signal to the light emitting diode with the amplifier;

wherein the first digital-to-analog converter meets a linear region step size resolution.

8. The method of claim 7 wherein the measured current from the brightness level detector is a digital signal.

9. The method of claim 8 further comprising:

receive the measured current from the brightness level detector with a second digital-to-analog converter;

converting the measured current into an analog measured current with the second digital-to-analog converter; and outputting the analog measured current to the analog comparator with the second digital-to-analog converter.

10. The method of claim 9 wherein the second digital-to-analog converter is designed to meet a brightness step resolution.

11. The method of claim 10 wherein the display panel is in a tablet computer, mobile phone, augmented reality display, notebook computer, computer display, or digital watch.

12. An apparatus comprising:

a display panel with multiple channels with a plurality of light emitting diodes (LEDs);

a brightness level detector configured to measure current delivered to the light emitting diodes; and, a plurality of current drivers configured to deliver charge to the light emitting diodes, each current driver comprising:

an integrator configured to determine accumulated charge delivered to the light emitting diodes of at least one of the multiple channels;

a analog comparator configured to compare the measured current and the determined accumulated charge;

a pulse width modulation control configured to terminate current from a peak current driver to the light emitting diode when the analog comparator determines that the determined accumulated charge is equal to a target charge associated with the measured current; and, a first digital-to-analog converter configured to receive a digital peak current signal and convert the peak current signal into an analog peak current signal.

13. The apparatus of claim 12 wherein the first digital-to-analog converter meets a linear region step size resolution.

14. The apparatus of claim 13, further comprising:

an amplifier configured to receive the analog peak current signal and to output an amplified peak current signal to the light emitting diode.

15. The apparatus of claim 14 further comprising:

a second digital-to-analog converter configured to:

receive the measured current from the brightness level detector, convert the measured current into an analog measured current, and output the analog measured current to the analog comparator.

16. The apparatus of claim 15 wherein the apparatus is a tablet computer, mobile phone, augmented reality display, notebook computer, computer display, or digital watch.

* * * * *